US006162333A

United States Patent [19]

Lemon et al.

[11] Patent Number: 6,162,333

[45] Date of Patent: Dec. 19, 2000

[54] ELECTROCHEMICAL CELL FOR REMOVAL OF METALS FROM SOLUTIONS

[75] Inventors: Charles E. Lemon, El Cerrito; Anthony A. Zante, Fremont, both of Calif.

[73] Assignee: Renovare International, Inc., Walnut Creek, Calif.

[21] Appl. No.: 09/235,173

[22] Filed: Jan. 22, 1999

[51] Int. Cl.[7] ..... C25B 9/00

[52] U.S. Cl. ..... 204/260; 204/284; 204/286

[58] Field of Search ..... 204/252, 260, 204/263, 284, 283, 286

[56] References Cited

U.S. PATENT DOCUMENTS

| | | | |
|---|---|---|---|
| 4,233,146 | 11/1980 | Rothmayer et al. | 204/255 |
| 4,367,127 | 1/1983 | Messing et al. | 204/105 R |
| 5,690,806 | 11/1997 | Sunderland et al. | 205/560 |
| 5,766,432 | 6/1998 | Tanaka et al. | 204/263 |

*Primary Examiner*—Kathryn Gorgos
*Assistant Examiner*—Thomas H Parsons
*Attorney, Agent, or Firm*—Elliot B. Aronson

[57] ABSTRACT

An electrochemical cell having a porous carbon fiber cathode supported on an elongate support member of open structure and a surrounding tubular anode. The cathode is provided with a current feeder that comprises a plurality of feeder strips, each extending substantially the length of the cathode, and in which the feeder strips are disposed substantially evenly around the elongate cathode support member. The feeder strips have an aggregate total width of at least about 20 percent of the characteristic circumferential dimension of the cathode support member. The feeder strips may be formed to conform to the curvature of the cathode support member. The cell may also be provided with an anode that is spaced apart from the inner wall of the outer casing by a distance of at least 2.5 mm, which provides an effective means of preventing gas buildup between the anode the outer casing. The cell is further provided with an improved microporous divider assembly that is disposed between the cathode and the anode so as to define separate anolyte and catholyte flow chambers. The divider assembly comprises a microporous membrane sandwiched between two porous supporting sleeves which squeeze the membrane so as to limit flexing movements under conditions of use. Certain modular constructions are also disclosed that serve to make the cell easily adaptable to different flow rates.

12 Claims, 6 Drawing Sheets

ELECTROCHEMICAL CELL FOR REMOVAL OF METALS FROM SOLUTIONS

BACKGROUND OF THE INVENTION

1. Technical Field

The invention relates to the construction of electrochemical cells for removal of metals from solutions, for example, to remove harmful metals from wastes to make the waste environmentally acceptable for disposal and to recover valuable metals from solutions.

2. Background Art

A number of electrochemical cells are known for recovery of metals from generally dilute solutions such as waste water or other effluents by means of electrodeposition of the metals from the solutions. Such a cell is disclosed for example in U.S. Pat. No. 5,690,806 of Sunderland et al. This cell includes an outer tubular casing that houses a cathode assembly in the form of a cylindrically shaped carbon fiber material wrapped about a mesh tubular support of generally open structure. A long current feeder running the length of the tubular support provides current to the carbon fiber cathode. The cathode assembly is surrounded by a concentric tubular anode spaced from the cathode. The electrolyte solution from which the metal is to be removed is introduced into the cell through an inlet and flows along a flow path carrying it through the porous carbon fiber cathode to an outlet while the metals of concern are deposited on the surfaces of the carbon fibers making up the cathode.

In general, in such cells, the maximum current density is usually limited by the ionic depletion of the electrolyte immediately adjacent the surface of the electrode on which material is deposited. In the cell of U.S. Pat. No. 5,690,806, for example, the porous carbon fiber cathode presents a greatly increased surface area in a generally efficient configuration for removal of metallic ions from the electrolyte solution. Notwithstanding the improved efficiency and performance of this cell, certain practical improvements remain to be needed for efficient high-volume industrial use. The present invention provides certain practical improvements in the cell of the aforementioned U.S. Pat. No. 5,690,806.

SUMMARY OF THE INVENTION

It is an object of the present invention to provide an electrochemical cell having a current feeder construction of improved functionality. In this regard, it is an object of the invention to provide a current feeder construction making it easier to remove spent cathodes.

It is another object of the invention to provide a cell having an anode construction preventing the trapping of gas along the cylinder wall behind the anode.

It is another object of the invention to provide an improved divided cell construction having an easily removable modular divider that allows for two separate circulation paths about the cathode and about the anode and that is better able to resist degradation in hostile environments.

It is another object of the invention to provide a cell with a modular replaceable end cap assembly so that the same cell can be used to accommodate different flow requirements without having to change the cathode or anode assemblies.

These and other objects may be achieved in a modified electrochemical cell of the general sort described in the above-mentioned U.S. Pat. No. 5,690,806, having a porous carbon fiber cathode supported on an elongate support member of open structure. In accordance with the invention, the cathode current feeder comprises a plurality of feeder strips, each extending substantially the length of the porous cathode, and in which the feeder strips are disposed substantially evenly around the elongate cathode support member. The feeder strips have an aggregate total width of at least about 20 percent of the characteristic circumferential dimension of the cathode support member. In addition, the feeder strips may be formed to conform to the curvature of the cathode support member so as to avoid unwanted electrodeposition at the current feeder strips and avoid other snags hindering the removal of a spent cathode from its support member. The cell of the present invention may also be provided with an anode that is spaced apart from the inner wall of the outer casing by a distance of at least about 2.5 mm, which provides an effective means of preventing gas buildup between the anode and the outer casing.

The cell of the present invention may also be provided with an improved microporous divider assembly that is disposed between the cathode and the anode so as to define separate anolyte and catholyte flow chambers. The divider assembly comprises a microporous membrane sandwiched between two porous supporting sleeves which contain, protect and immobilize the membrane so as to limit flexing movements under conditions of use and thereby extend the life of the membrane.

The cell according to the invention may also be provided with certain modular constructions as described more fully hereinbelow and that serve to make the cell easily adaptable to different flow rates.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
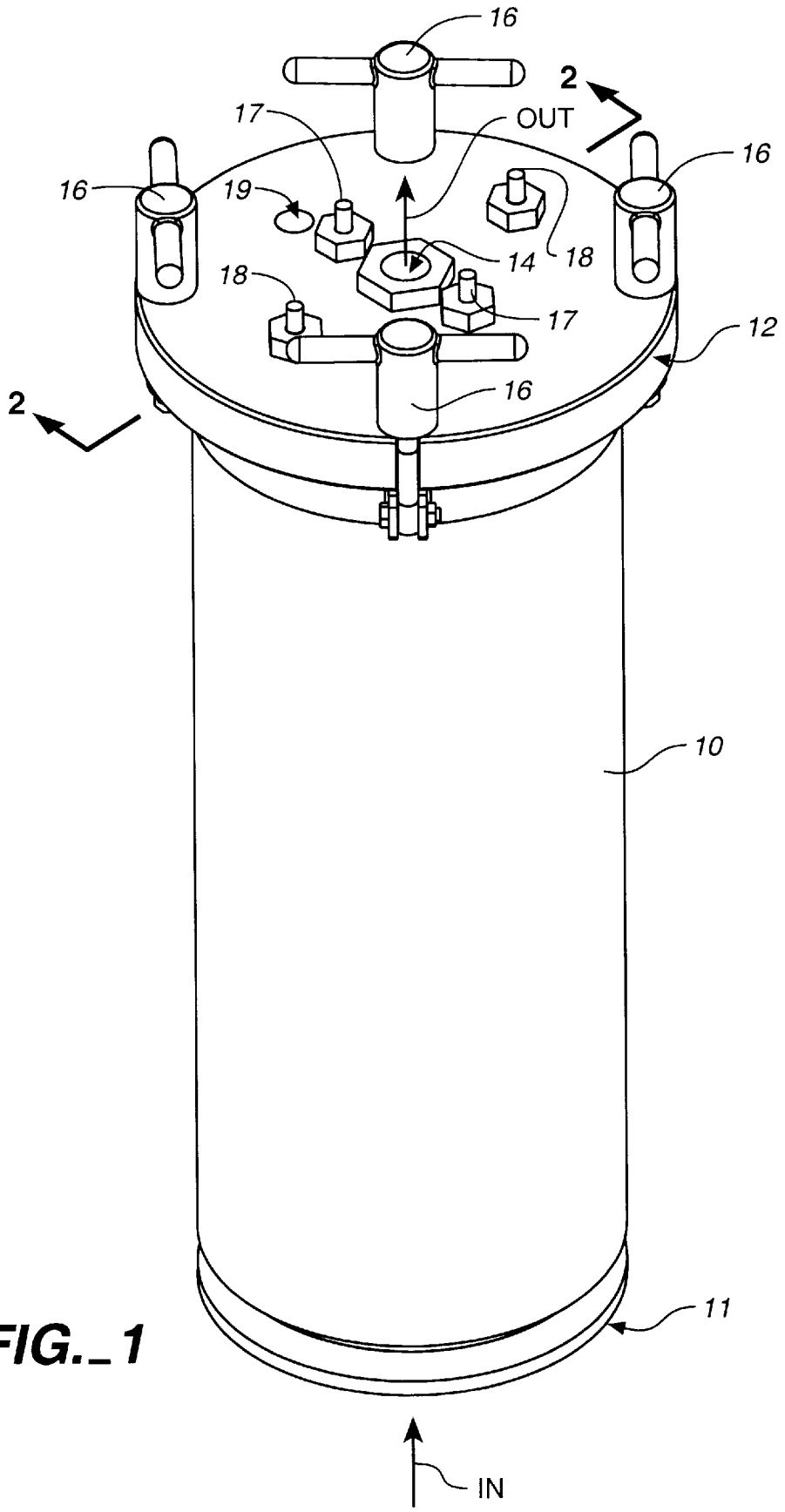
FIG. 1 is an overall isometric view of an embodiment of electrochemical cell in accordance with the invention.
Figure 2:
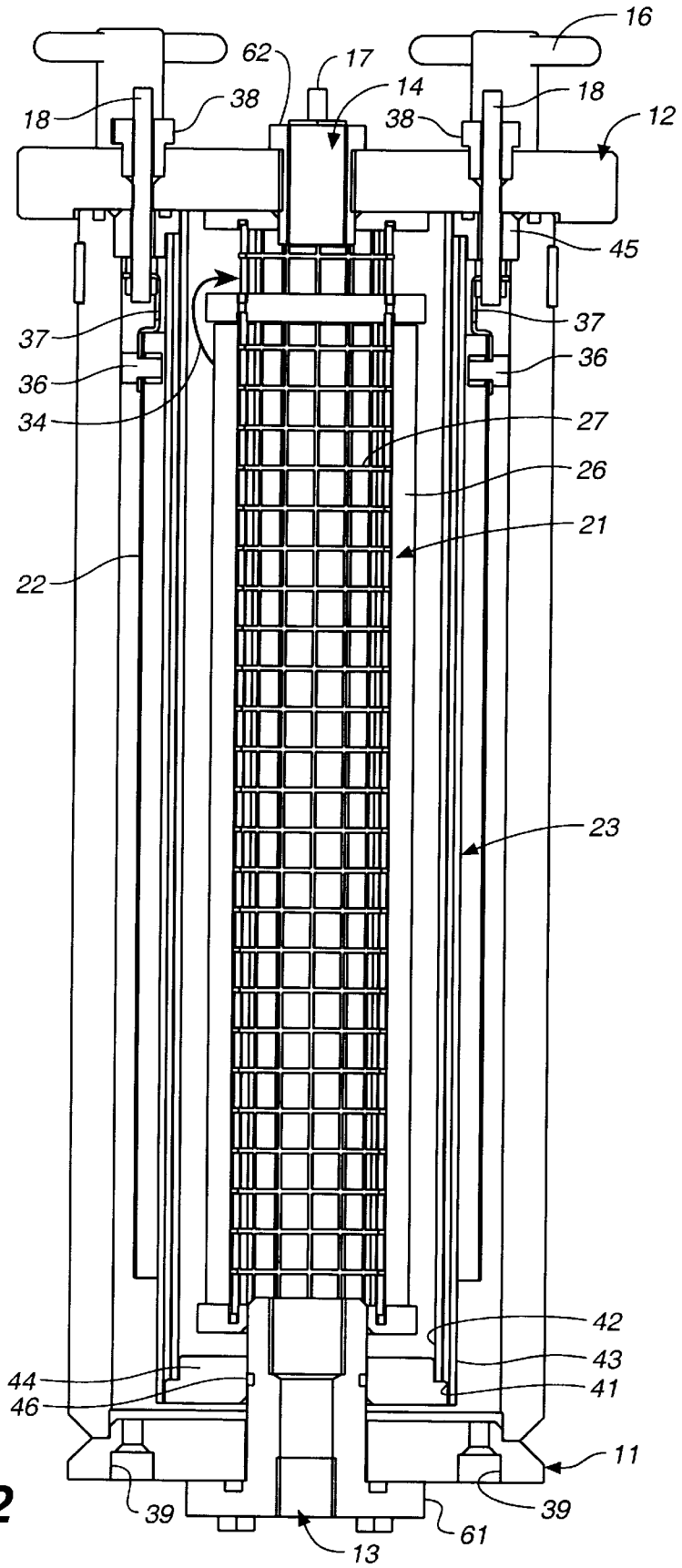
FIG. 2 is a sectional view taken along the line 2—2 in FIG. 1.

FIGS. 1 and 2 show exterior and interior views of an embodiment of an electrochemical cell incorporating the improvements of the present invention. The cell is housed in an outer casing 10 of generally tubular shape, which is terminated at its ends by end caps 11 and 12. Centrally positioned in end cap 11 is a flow inlet 13 (visible in FIG. 2) and in end cap 12 is a flow outlet 14. The solution under treatment enters the cell in a continuous flow through inlet 13 where it is subjected to electrolytic action to remove the metals or metallic ions of concern and then exits through outlet 14. Also shown in FIG. 1 are a plurality of toggle bolts 16 for removably securing top end cap 12 to casing 10, cathode current feeder posts 17, anode current feeder posts 18, and an anolyte flow outlet 19 which is provided in an optional embodiment of the cell as will be described in greater detail below. It is noteworthy that all of these mechanical elements 16–19 are positioned at the end cap so as not to protrude laterally to any substantial extent beyond the periphery of the end cap, and no such mechanical elements protrude from the tubular sides of casing 10. This is of great practical convenience in avoiding breakage during handling of the cell as, for example, during shipping, installation or exchanging of cathode members within the cell.

The electrochemical cell contains a cathode assembly 21, an anode 22, and a divider assembly 23 disposed between cathode assembly 21 and anode 22 so as to divide the interior of the cell into two distinct chambers for separate flows past cathode assembly 21 and anode 22. Divider assembly 23 is an optional component that is used in applications where it is desired to prevent exposure of the catholyte to the anode. For example, in certain applications, toxic chlorine gas may be produced at the anode, and for safety it is advisable to prevent generation of this gas. In the embodiment illustrated here, divider assembly 23 is of a modular nature that may be easily inserted into the cell for those applications in which its use is called for and removed from the cell when not needed. The structure and operation of divider assembly 23 will be described in more detail below.

Cathode assembly 21 will now be described with reference to FIGS. 3–5. The cathode assembly comprises a porous cathode member 26 supported on a porous elongate support member 27, and a plurality of cathode current feeder strips 28 establishing electrical contact with cathode member 26. Cathode member 26 is itself of a known type such as discussed for example in U.S. Pat. No. 5,690,806 of Sunderland et al. It is formed of a porous carbon fiber material, which because of the porous structure presents a large surface area to volume ratio. The carbon fiber material may be provided in the form of a flat felt or matting that is supplied in a roll and is cut to size and wrapped around support member 27. Alternatively, the carbon fiber material may be pre-formed as a hollow cylinder sized and shaped for installation on support member 27.

Figure 4:
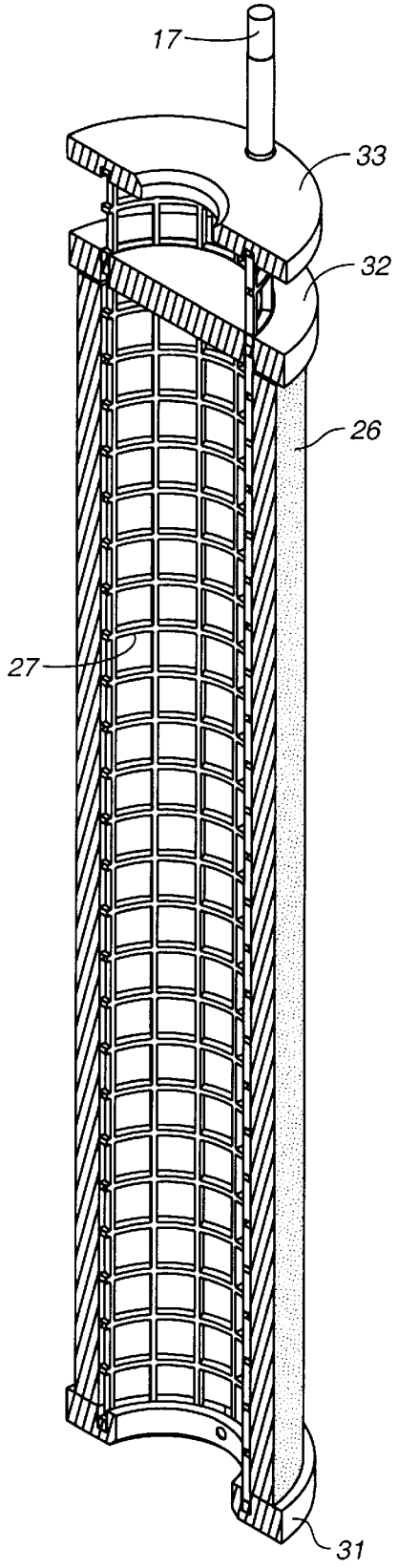
FIG. 4 is a sectional view of the embodiment of FIG. 3.
Figure 5A:
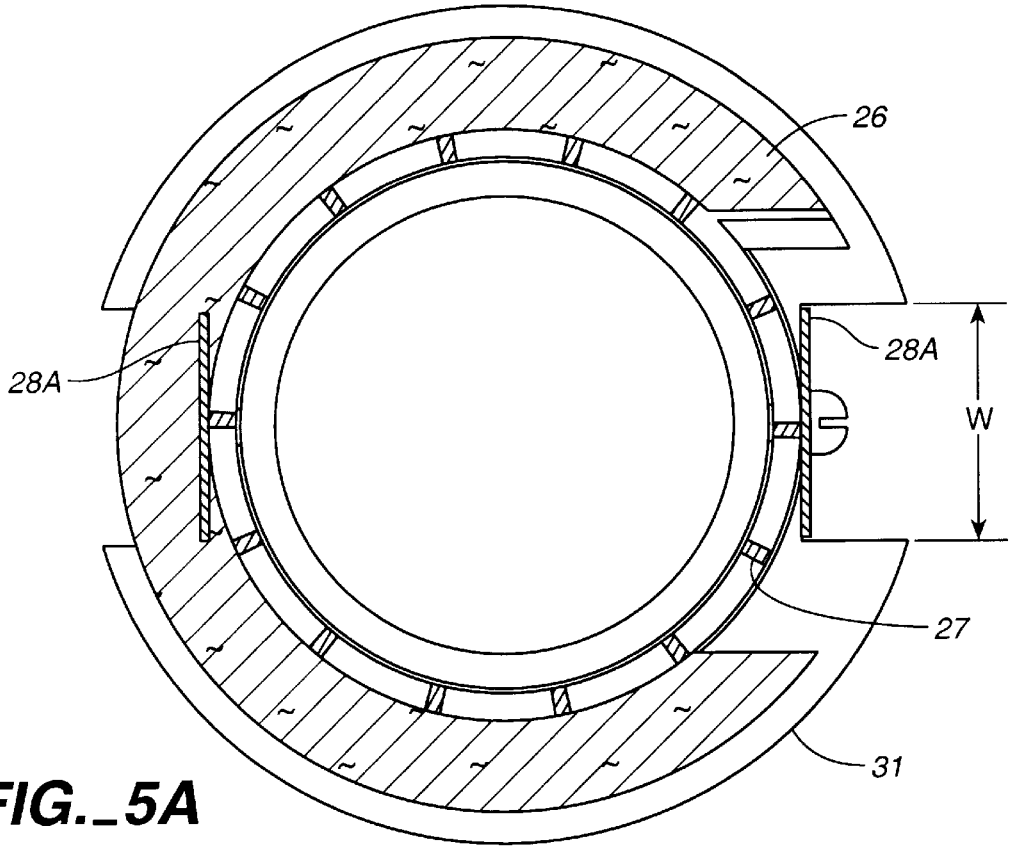
FIG. 5A is a cross-sectional view of the cathode assembly taken along the line 5A—5A in FIG. 3.

In the illustrated embodiment, support member 27 is generally tubular in shape, and as seen in FIGS. 2, 4 and 5A and B it is a cylinder of circular cross section. Support member 27 is sufficiently porous to permit the flow of electrolyte solution through the support member. As shown here, the porosity is provided by forming the tubular wall of support member 27 as an open mesh structure or grid pattern. Alternative constructions, however, may also be used. For example, the support member may comprise a perforated cylinder or may be formed of a porous polyethylene or may comprise an appropriate filter cloth supported on an open structure so that the desired flow regime may be controlled by selection of the filter cloth. In the present embodiment, it is contemplated that support member 27 be non-conducting, although in other embodiments it could be conducting, in which case the support member would also aid in the current feeder function.

As used herein "porous" is intended in its most general sense of "penetrable." Thus, porous support member refers to a support member having appropriately sized openings to be penetrable by the electrolyte solution as called for in the desired flow regime. The "pores" of the support member may be provided by the large cells of a mesh structure as shown in the figures or large or small perforations in the support member wall or the small pores of a filter cloth. The carbon cathode member is porous in the same sense that the electrolyte solution may penetrate into the carbon material. The "pores" of the porous carbon cathode member may also range from smaller to larger depending on the particular material chosen for the cathode member and will not generally be the same size or shape as the pores of the cathode support member. It is generally contemplated that the pores of the cathode member will be smaller than those of the support member and will be formed by the voids and interstices of the carbon fiber material forming the cathode member.

The current feeder provides the electrical connection to the cathode member. It is recognized in the art (see for example U.S. Pat. No. 5,690,806 of Sunderland et al.) that for efficient electrolysis, and in particular for more uniform deposition of metal on the cathode member, it is desirable to provide a generally even distribution of current to the cathode member. It has been found in the present invention that improved performance is achieved when the cathode current feeder is provided by a plurality of elongate conducting strips 28 which are distributed substantially evenly about the circumferential periphery of cathode support member 27 and which run substantially the length of cathode member 26 and have a substantial aggregate width compared with the circumferential dimension, that is to say, the distance around the circumferential periphery, of support member 27. More particularly, it has been found that the aggregate width of the strips should be at least twenty percent of the characteristic circumferential dimension of support member 27. In practice, an aggregate width of about twenty-five percent of the circumferential dimension has been found particularly effective. This arrangement provides for more uniform current distribution, hence, greater metal deposition, and reduced heat due to reduced ohmic losses in the current strips.

Figure 5B:
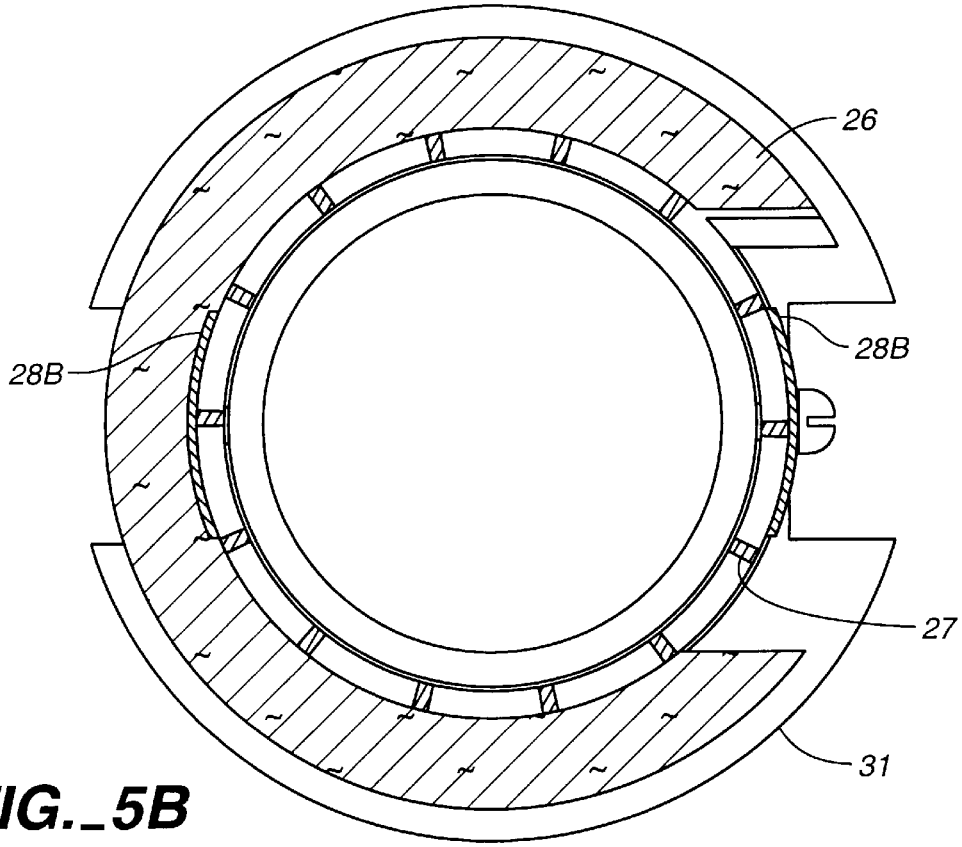
FIG. 5B is a cross-sectional view of the cathode assembly showing an alternative embodiment of the cathode current feeder strips.

The illustrated embodiment employs two such strips 28 disposed at diametrically opposed positions about the circular periphery of support member 27 as seen in FIGS. 5A and 5B. A greater number of strips than two may also be used. In the embodiment of FIG. 5A strips 28A are flat, each having a characteristic width w. The aggregate total of the widths is 2w, which is to be greater than approximately 20 percent of the circumference of support member 27. In the embodiment of FIG. 5B the strips 28B are curved to conform to the circumferential periphery of support member 27. The purpose of this may be understood as follows. In operation, the metals of concern are deposited on the surfaces in the interstices of the porous carbon cathode member. After a period of operation, the cathode member will become loaded with deposited metals and will have to be replaced. This is accomplished by opening the cell at end cap 12 and removing the entire cathode assembly. The loaded cathode member 26 is then slipped off of support member 27 and replaced with a clean cathode member. However, in some applications a loaded cathode member may tend to catch on the edges of support strip 28A in FIG. 5A. In part, this is due to the tendency for a small amount of metal to be deposited at the exposed underside of strip 28A. In such cases, the loaded cathode member may be removed more easily by conforming the strips 28B to the shape of support member 27 as in FIG. 5B.

Although support member 27 is shown herein as cylindrical, to facilitate removal of a loaded cathode member, the support member may be given a slight taper. In this case, if the cathode member is pre-formed in a hollow, generally cylindrical shape, then at least the inside wall of the cylinder should also be given a slight taper so as to mate with the taper of the support member. In this case, the circumferential dimension of the support member will vary depending on the location of the measurement along the length of the support member. However, only a slight taper is needed and the variation in the circumferential dimension will be small. In this case, any value of the circumferential dimension along the support member, for example, the value at mid-length, may be taken as the characteristic circumferential dimension for purposes of determining an acceptable aggregate width of current feeder strips 28.

Figure 3:
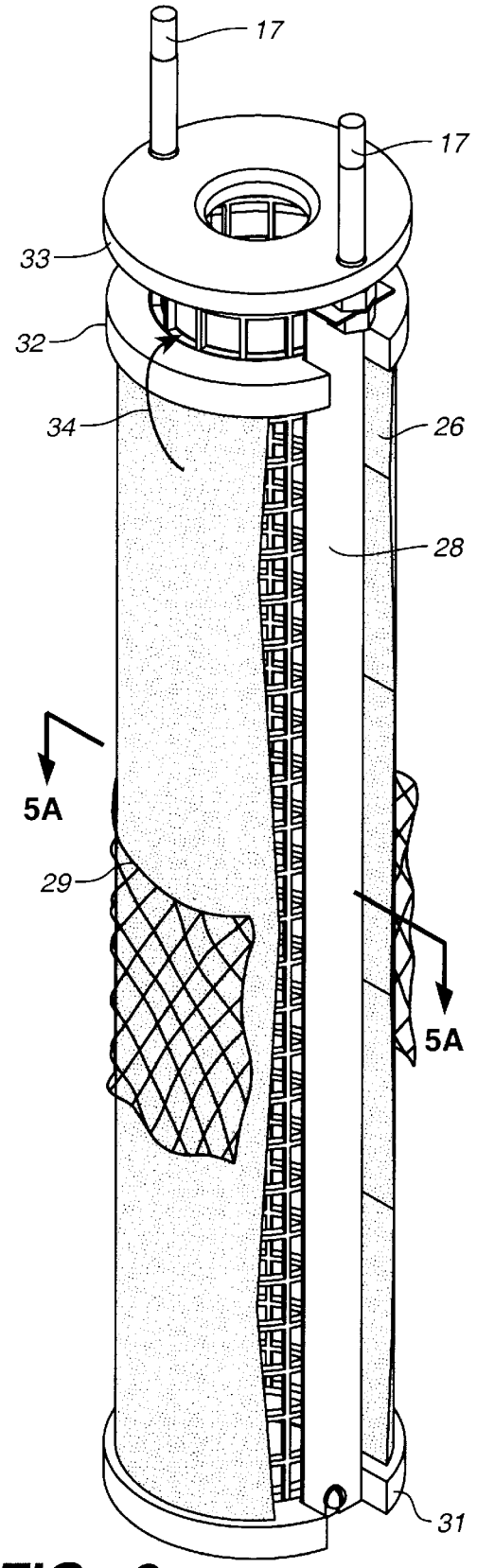
FIG. 3 is a partially cut-away isometric view of an embodiment of a cathode assembly according to the invention.

Cathode member 26 is secured on support member 27 by a generally tubular encasing sheath 29 shown in fragmentary part in FIG. 3. The use of such a sheath is known and is disclosed for example in U.S. Pat. No. 5,690,806, which teaches the use of a plastic encasing mesh or plastic ties to secure the cathode member to the support member. It has been found that a better electrical contact and current distribution is achieved, however, if the encasing sheath is formed of an elastomeric material and is sized so that the sheath uniformly squeezes cathode member 26 against current feeder strips 28. The use of an elastomeric encasing sheath 29 more successfully withstands and counteracts the strains experienced by cathode member 26 during operation.

Cathode assembly 21 is terminated by an annular end piece 31 at the inlet side of the cathode assembly having a laterally protruding surface for restraining cathode member 26. Inlet 13 extends into the center of support member 27 through the center of annular end piece 31. One end of current feeder strips 28 is secured to end piece 31 by small screws. It is an advantage of the present construction that end piece 31 may be easily removed simply by removing these screws and dislodging the end piece from the end of support member 27. This provides for easy removal of a spent cathode member 26, which may then be slid off the support member.

At the other end of cathode assembly 21 is a first annular baffle plate 32 and a second annular end piece 33 spaced apart from baffle plate 32. Porous support member 27 extends beyond baffle plate 32 to end piece 33. Outlet 14 extends through the hole in annular end piece 33. In this manner, the electrolyte solution is introduced into the center of support member 27 through inlet 13 and is prevented from flowing directly out of outlet 14 by baffle plate 32. The electrolyte solution is thus forced to flow through the openings of porous support member 27 and through cathode member 26, where the metals are deposited, to the space outside of cathode member 26. The solution thus substantially depleted of its metal content flows back through the porous support member in the region between baffle plate 32 and end piece 33 as indicated by arrow 34 in FIGS. 2 and 3 and exits through outlet 14.

Also included in cathode assembly 21 are two cathode current feeder posts 17 for making electrical connection to current feeder strips 28. Posts 17 are bolted to strips 28 at end plate 33 and in the assembled cell extend through end cap 12 for connection to an electrical supply.

Anode 22 is provided by a conducting cylinder surrounding and generally concentric with cathode assembly 21. The construction of such an anode and suitable choice of materials are well known in the art and need not be discussed in detail here. An anode construction as in U.S. Pat. No. 5,690,806 of Sunderland et al. will generally suffice here with the following modification. The anode as disclosed in U.S. Pat. No. 5,690,806 is concentric with and abutting against the inner wall of the tubular external casing. It has been found that improved performance is achieved if anode 22 is spaced apart from the inner wall of outer casing 10 by a characteristic offset distance. This is apparently due to the small amount of flow that can then take place behind anode 22 which is sufficient to remove heat produced by ohmic losses and prevent buildup of gas pockets between anode 22 and the inner wall of casing 10. An offset distance of at least about 2.5 mm has been found sufficient with a spacing of about 5 mm being preferred. In the illustrated embodiment the offset is accomplished by spacers 36. In FIG. 2 the spacers 36 are provided by the head of a bolt which also serves to secure anode 22 to conducting brackets 37. The conducting brackets are in turn connected to anode current feeder posts 18. Posts 18 are threaded at their anode ends for this purpose. Posts 18 extend through end cap 12 through plugs 38 for connection to the electrical supply.

In some systems it may be desirable to configure the electrochemical cell with anode and cathode connections at opposite ends of the cell. To accommodate such systems with the same cell, end cap 11 is provided with an alternative pair of anode current feeder openings 39 symmetrically disposed with respect to the openings in end cap 12. Anode 22 together with anode current feeder posts 18 and attachment brackets 37 may then simply be reversed, and the unused pair of current feeder openings is plugged.

As explained above, when it is desired to provide separate non-mixing flows for the catholyte solution about the cathode and the anolyte solution about the anode, optional divider assembly 23 may be inserted between the anode and cathode assembly. The present divider assembly, as other known divider assemblies of the prior art, includes a microporous membrane 41 which is impervious to water but which permits the migration of appropriate ions across the membrane. In the past, it has been found that in use the microporous membranes tend to weaken and burst more frequently than desired. The present invention strengthens the membrane and increases its useful life under conditions of use by supporting membrane 41 on both sides by a pair of inner and outer porous supporting sleeves 42 and 43. The supporting sleeves may be an open mesh structure or perforated plastic tubular members coaxially disposed with membrane 41 sandwiched between them such that the inner and outer sleeves press and constrain membrane 41 from both sides. In this way, the sleeves minimize the flexing movement of the membrane during use.

In the embodiment of FIG. 2 divider assembly 23 includes annular end pieces 44 and 45 at each end. End pieces 44 and 45 have a stepped shape so that inner sleeve 42 and membrane 41 abut against a first step and outer sleeve 43 extends beyond them to abut against the next step in end piece 44. For end piece 45 inner sleeve 42 extends beyond outer sleeve 43 as is shown in FIG. 2. The membrane and sleeves are secured in place by a suitable waterproof adhesive. End pieces 44 and 45 form watertight seals against the inlet and outlets which extend through the central openings in the annular end pieces. Suitable seals may be formed for example with o-rings. See for example o-ring 46 at end piece 44 in FIG. 2.

Figure 6A:
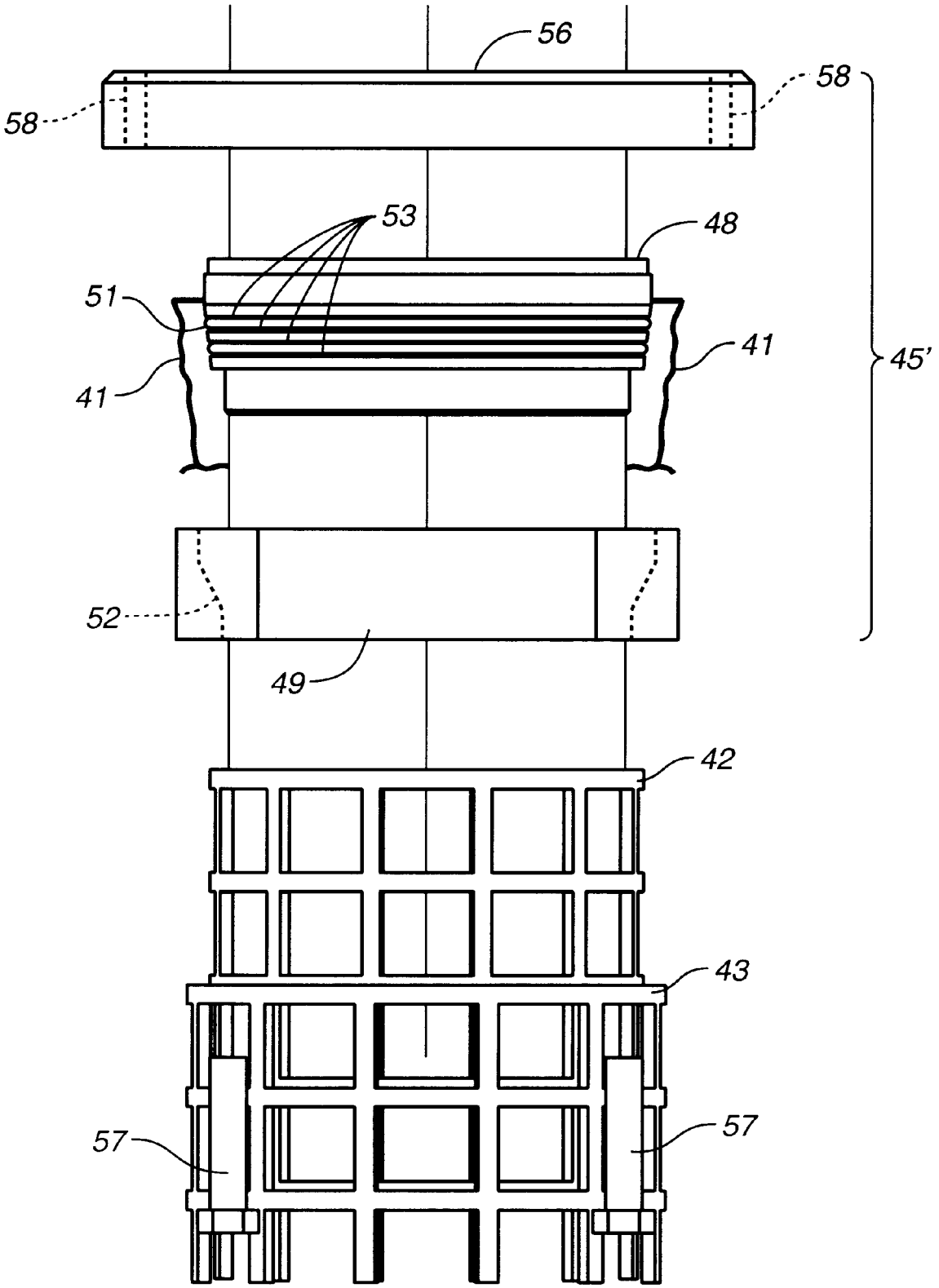
FIGS. 6A and 6B are exploded elevational views showing an alternative embodiment of the end caps for securing the divider assembly.
Figure 6B:
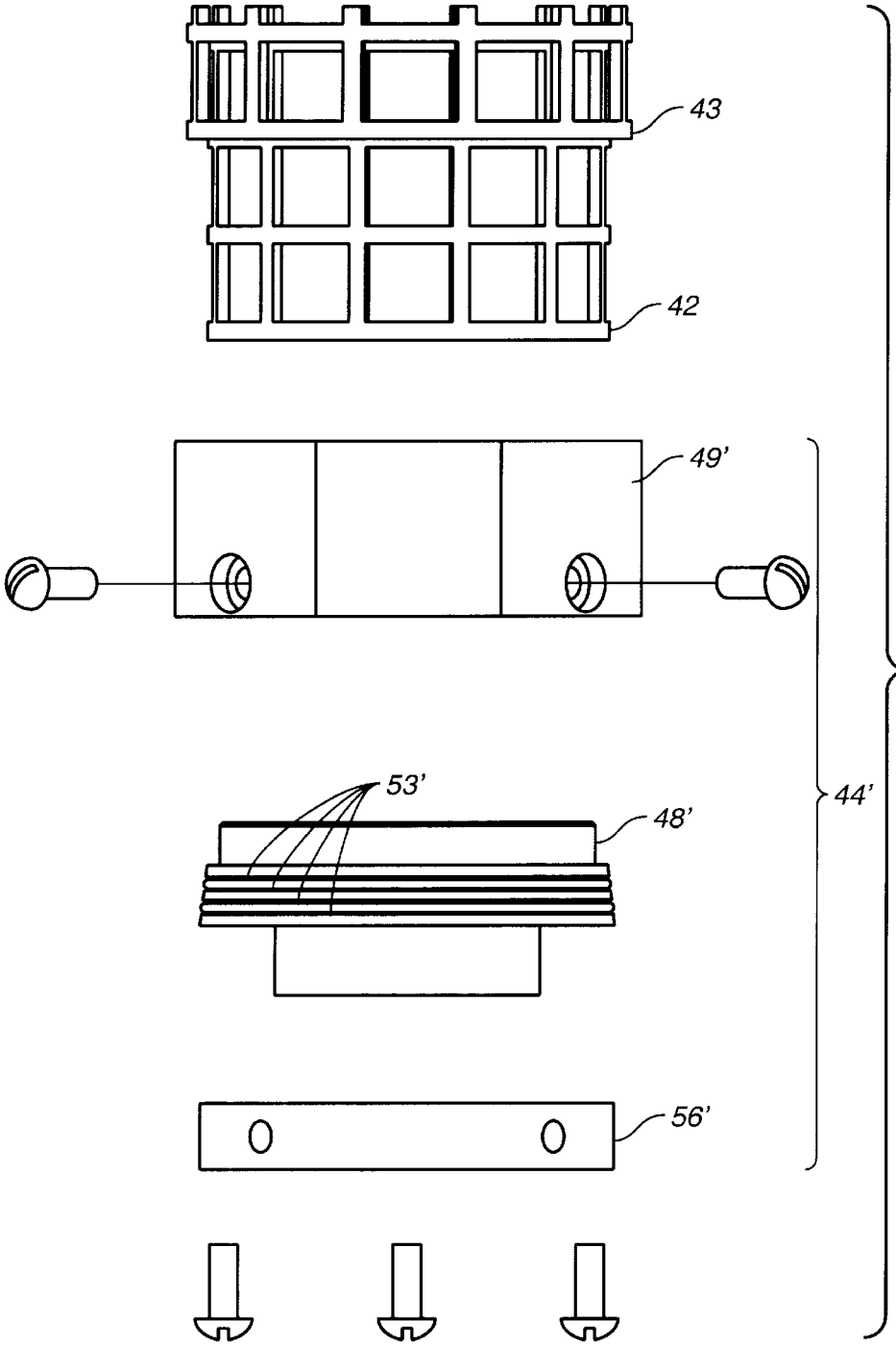

It has been found, however, that in some corrosive environments the adhesives securing membrane 41 and sleeves 42 and 43 in place tend to degrade and the divider assembly eventually begins to leak. FIGS. 6A and 6B show an alternative embodiment for the end pieces, which are designated with reference numerals 44' and 45'. End piece 45' includes a pair of nesting annular members 48 and 49 that have mating sloped walls 51 and 52. The sloped wall 51 of inner annular member 48 carries one or more o-rings 53.

Membrane 41 (shown in fragmentary part in FIG. 6A for purposes of illustration) is stretched over o-rings 53 and pressed into place by outer annular member 49. Annular members 48 and 49 are squeezed together and capped by a third annular member 56, and the assembly is secured in position by bolts 57. Cap 56 is provided with bore holes 58 for anode current feeder posts 18.

The bottom end piece 44' is much the same construction as top end piece 45' except that the cap annular member 56' need not be as wide as cap member 56 in end piece 45' and thus no provision need be made for the alternative positioning of the anode current feeder posts. In FIG. 6B comparable elements are labeled by like reference numerals with added primes.

To provide the cell of the present invention with greater flexibility for use in different applications, end caps 11 and 12 are formed with a modular structure permitting them to be adapted easily for different flow rates. End cap 11 is provided with a removable modular insert member 61 which defines inlet 13. For a different entrance channel it is only needed to replace insert member 61 by a comparable piece having a different inlet bore. Similarly, end cap 12 may be provided with a removable modular insert member 62 defining the bore of outlet 14. This construction has the advantage that it allows the end user, for example, to quickly and easily back-flush the system for maintenance purpose at a higher flow rate, and thus more expeditiously, simply by changing the inserts. The modular construction in addition saves on manufacturing, shipping and inventory costs because the same basic cell may be provided for different applications and only the inserts need be changed.

The above descriptions and drawings disclose illustrative embodiments of the invention. Given the benefit of this disclosure, those skilled in the art will appreciate that various modifications, alternate constructions, and equivalents may also be employed to achieve the advantages of the invention. For example, although support member 27 is illustrated herein with a circular cross section, and this profile is generally preferred because of the resulting symmetrical disposition of cathode member and hence of the resulting electric field, other cross sectional profiles may also be used to achieve different cell geometries, for example, to meet particular requirements of an application. In such cases, the current feeder strips will be appropriately disposed about the new support member profile to achieve a substantially uniform current distribution to the cathode member. Other adaptations of shape and materials, for example, may also occur to the person of ordinary skill given the benefit of this disclosure leading to embodiments of electrochemical cells differing in details from the embodiments shown and described above, yet still enjoying the benefits of the invention. For this reason, the invention is not to be limited to the above description and illustrations, but is defined by the appended claims.

What is claimed is:

1. An electrochemical cell for the electrolytic removal of at least one metal from solution, the cell including an outer casing, a cathode assembly centrally disposed within the outer casing, an anode within the outer casing spaced from the cathode, an inlet and an outlet for the solution, wherein the cathode assembly comprises a porous elongate support member having a circumferential periphery of characteristic circumferential dimension, a porous cathode member formed of a porous carbon fiber material disposed about the elongate support member, and a cathode current feeder supported on the elongate support member and extending substantially along the entire length of the porous cathode member, the cathode assembly, inlet and outlet being disposed such that in use the solution enters the cell through the inlet, flows through the porous cathode member and exits the cell through the outlet, said cell being characterized in that said cathode current feeder comprises a plurality of feeder strips, each extending substantially the length of said porous cathode member, said plurality of feeder strips being disposed substantially evenly about said circumferential periphery of said elongate support member, wherein each said feeder strip has a characteristic width and the aggregate total of said characteristic widths comprises at least 20 percent of said characteristic circumferential dimension.

2. The apparatus of claim 1 further characterized in that said elongate support member has a generally tubular shape, and said feeder strips are substantially flat and are disposed tangentially along their characteristic widths to said circumferential periphery of said tubular shape.

3. The apparatus of claim 2 further comprising a generally tubular porous sheath about said porous cathode member, said apparatus being further characterized in that said sheath is formed of an elastomeric material and is sized to squeeze said porous cathode member into electrical contact with said feeder strips.

4. The apparatus of claim 1 further characterized in that said elongate support member has a generally tubular shape, and said feeder strips are shaped and disposed along their characteristic widths generally to conform to the curvature of said circumferential periphery of said tubular shape.

5. The apparatus of claim 4 further comprising a generally tubular porous sheath about said porous cathode member, said apparatus being further characterized in that said sheath is formed of an elastomeric material and is sized to squeeze said porous cathode member into electrical contact with said feeder strips.

6. The apparatus of claim 1 further characterized in that said cathode assembly further comprises an end piece disposed at an end of said support member and formed to restrain said cathode member on said support member;

said plurality of feeder strips being releasably secured to said end piece at first ends of said feeder strips; and said end piece being arranged to be maintained in position on said support member by said releasably secured feeder strips;

whereby said end piece may be easily released and removed from said support member thereby enabling easy removal of a spent said cathode member.

7. The apparatus of claim 1 wherein said outer casing is of a generally tubular shape having first and second end caps at the ends thereof wherein said inlet is disposed in said first end cap, said apparatus being further characterized in that said first end cap includes a first removable modular insert defining said inlet and formed to establish flow connection with said cathode assembly, whereby a user may adapt the apparatus for a different flow requirement by replacing said first removable modular insert with a like removable modular insert defining an inlet of different size and without having to remove or replace said cathode assembly.

8. The apparatus of claim 7 wherein said outlet is disposed in said second end cap and said apparatus is further characterized in that said second end cap includes a second removable modular insert defining said outlet, whereby a user may further adapt the apparatus for a different flow rate by replacing said second removable modular insert with a like removable modular insert defining an outlet of different size.

9. The apparatus of claim 7 further comprising at least one anode current feeder extending through said second end cap, wherein said apparatus is further characterized in that said anode is adapted for connection to said at least one anode current feeder at opposite ends of said anode, said at least one anode current feeder is selectively attachable to and detachable from said anode at said opposite ends, and said first end cap is formed with alternate openings for receiving said at least one anode current feeder, whereby the apparatus may be selectively configured for electrical connection to said anode at either of said first and second end caps.

10. The apparatus of claim 1 wherein said outer casing and said anode are of generally tubular shape and are concentric with one another, said apparatus being further characterized in that said anode is spaced apart from the inner wall of said outer casing by a distance of at least 2.5 mm.

11. The apparatus of claim 1 further comprising a microporous divider assembly disposed between said cathode assembly and said anode so as to define separate anolyte and catholyte chambers, said apparatus being further characterized in that said divider assembly comprises a microporous membrane, and inner and outer porous supporting sleeves, said microporous membrane being sandwiched between said supporting sleeves.

12. The apparatus of claim 11 wherein said inner and outer porous supporting sleeves are of generally concentric tubular mesh shape pressing said microporous membrane therebetween.

* * * * *